US007987806B2

(12) United States Patent
Chang

(10) Patent No.: US 7,987,806 B2
(45) Date of Patent: Aug. 2, 2011

(54) DETACHABLE INFLATABLE RUBBER BOAT

(76) Inventor: Herry Chang, Taipei (TW)

( * ) Notice: Subject to any disclaimer, the term of this patent is extended or adjusted under 35 U.S.C. 154(b) by 314 days.

(21) Appl. No.: 12/382,257

(22) Filed: Mar. 12, 2009

(65) Prior Publication Data

US 2010/0229778 A1 Sep. 16, 2010

(51) Int. Cl.
*B63B 7/08* (2006.01)

(52) U.S. Cl. ..... 114/345

(58) Field of Classification Search ..... 114/345; 441/40

See application file for complete search history.

(56) References Cited

U.S. PATENT DOCUMENTS 4,528,927 A * 7/1985 Iizuka et al. ..... 114/125
4,722,292 A * 2/1988 Marino et al. ..... 114/140
6,192,822 B1 * 2/2001 Lavorata et al. ..... 114/345

* cited by examiner

*Primary Examiner* — Ed Swinehart
(74) *Attorney, Agent, or Firm* — Rosenberg, Klein & Lee

(57) ABSTRACT

An inflatable rubber boat includes a flat bottom fabric member formed of a fabric having a front V-cut and two lateral sides, the two border edges of the front V-cut being seamed together to form a forwardly upwardly curved front end edge of the flat bottom fabric member, an elongated main inflatable airbag member fastened to the forwardly upwardly curved front end edge and two lateral sides of the flat bottom fabric member, a floorboard member having a body fitting over the flat bottom fabric member and a pointed arch-shaped rib obliquely upwardly extended from the front side of the body and fastened to the contained angle defined between the upwardly curved front end edge of the flat bottom fabric member and the elongated main inflatable airbag member, and a supplementary inflatable airbag member longitudinally set between the floorboard member and the flat bottom fabric member and inflated to stretch the flat bottom fabric member into shape.

9 Claims, 5 Drawing Sheets

DETACHABLE INFLATABLE RUBBER BOAT

BACKGROUND OF THE INVENTION

1. Field of the Invention

The present invention relates to inflatable rubber boats and more particularly, to a detachable inflatable rubber boat that allows the parts thereof be detached from one another and folded up to safe storage space during delivery.

2. Description of the Related Art

A regular inflatable rubber boat generally has a flat bottom and a lifted bow. However, because the lifted bow has a flat bottom surface, it does not break the surface of water efficiently. In consequence, much resistance is produced during moving of the inflatable rubber boat. High water resistance may cause the inflatable rubber boat to deviate from the course or to fall down. Further, the flat bottom of a conventional inflatable rubber boat may be simply formed of a fabric material. It is unstable stand upright on the flat bottom of fabric material. There is known another design of inflatable rubber boat that has a hard floorboard mounted on the flat bottom thereof. However, this hard floorboard is not detachable. During delivery, this design of inflatable rubber boat occupies much storage space.

SUMMARY OF THE INVENTION

The present invention has been accomplished under the circumstances in view. It is therefore the main object of the present invention to provide detachable inflatable rubber boat, which allows the parts thereof be detached from one another and folded up to safe storage space during delivery.

To achieve this and other objects of the present invention, an inflatable rubber boat comprises a flat bottom fabric member, an elongated main inflatable airbag member fastened to the forwardly upwardly curved front end edge and two lateral sides of the flat bottom fabric member, a floorboard member having a body fitting over the flat bottom fabric member and a pointed arch-shaped rib obliquely upwardly extended from the front side of the body and fastened to the contained angle defined between the upwardly curved front end edge of the flat bottom fabric member and the elongated main inflatable airbag member, and a supplementary inflatable airbag member longitudinally set between the floorboard member and the flat bottom fabric member and inflated to stretch the flat bottom fabric member into shape.

Further, the flat bottom fabric member is formed of a fabric having a front V-cut and two lateral sides. The two border edges of the front V-cut are seamed together to form a forwardly upwardly curved front end edge of the flat bottom fabric member. The supplementary inflatable airbag member comprises a V-shaped edge located on the bottom side and longitudinally extended to the front end to facilitate water surface breaking and to reduce water resistance.

Further, the pointed arch-shaped rib of the floorboard member is detachably connected to the body of the floorboard member, the body of the floorboard member is formed of a number of parts detachably fastened together. When the inflatable rubber boat is flattened, the major parts of the inflatable rubber boat can be detached from one another and stacked up and folded up, saving much storage space to facilitate delivery.

DETAILED DESCRIPTION OF THE PREFERRED EMBODIMENT

Figure 1:
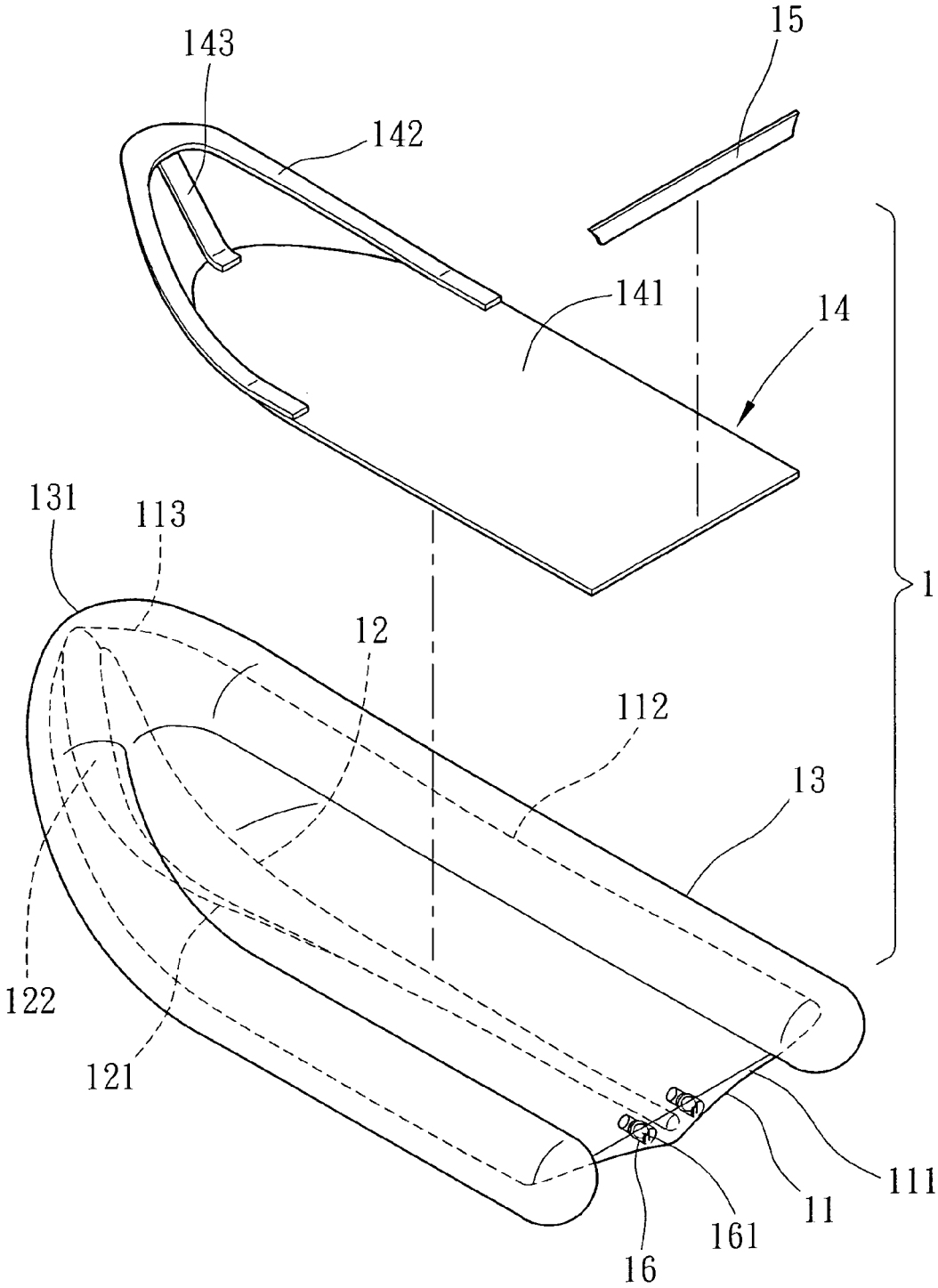
FIG. 1 is an exploded view of an inflatable rubber boat in accordance with the present invention.
Figure 2:
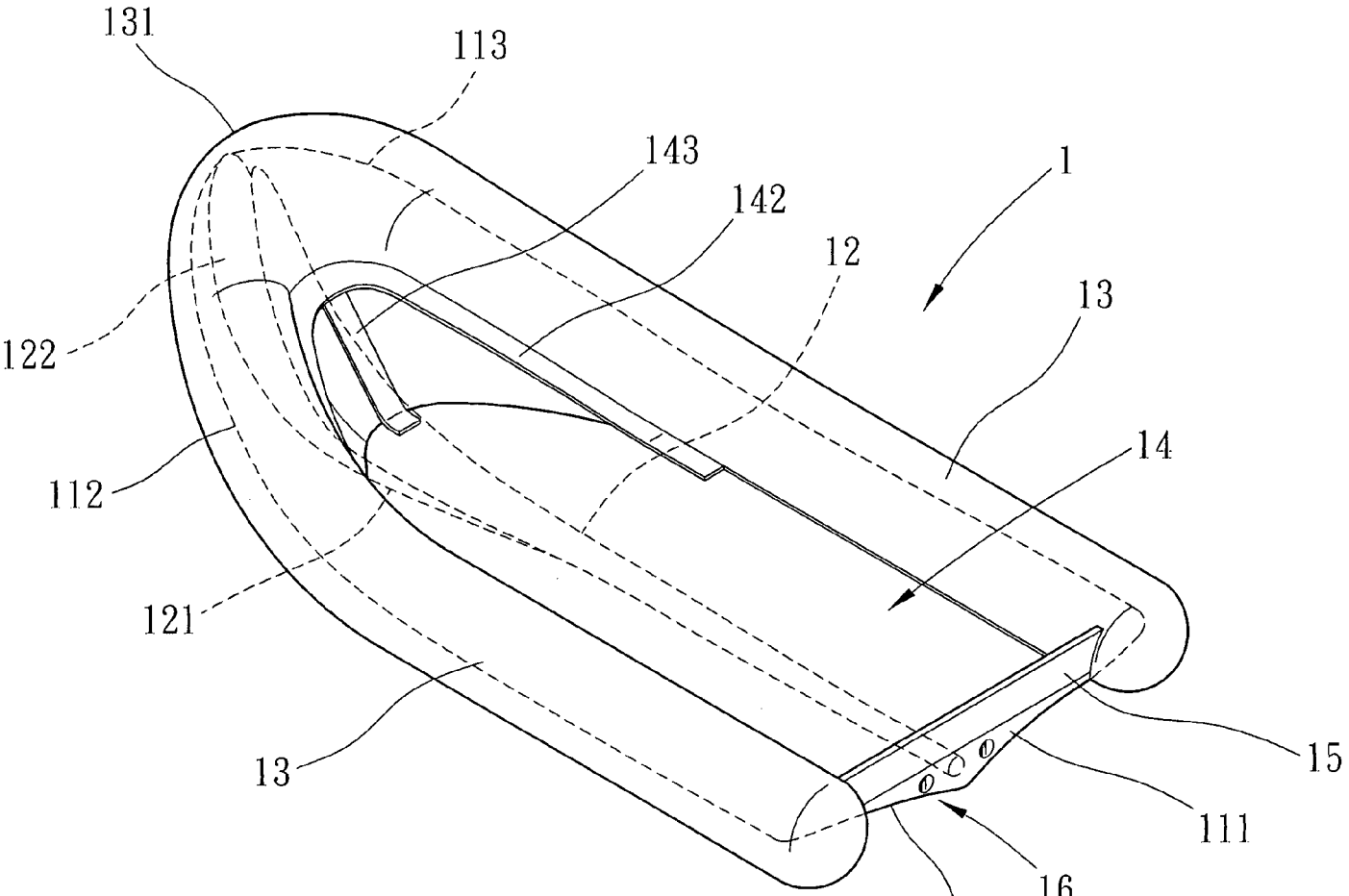
FIG. 2 is a perspective assembly view of the inflatable rubber boat in accordance with the present invention.
Figure 3:
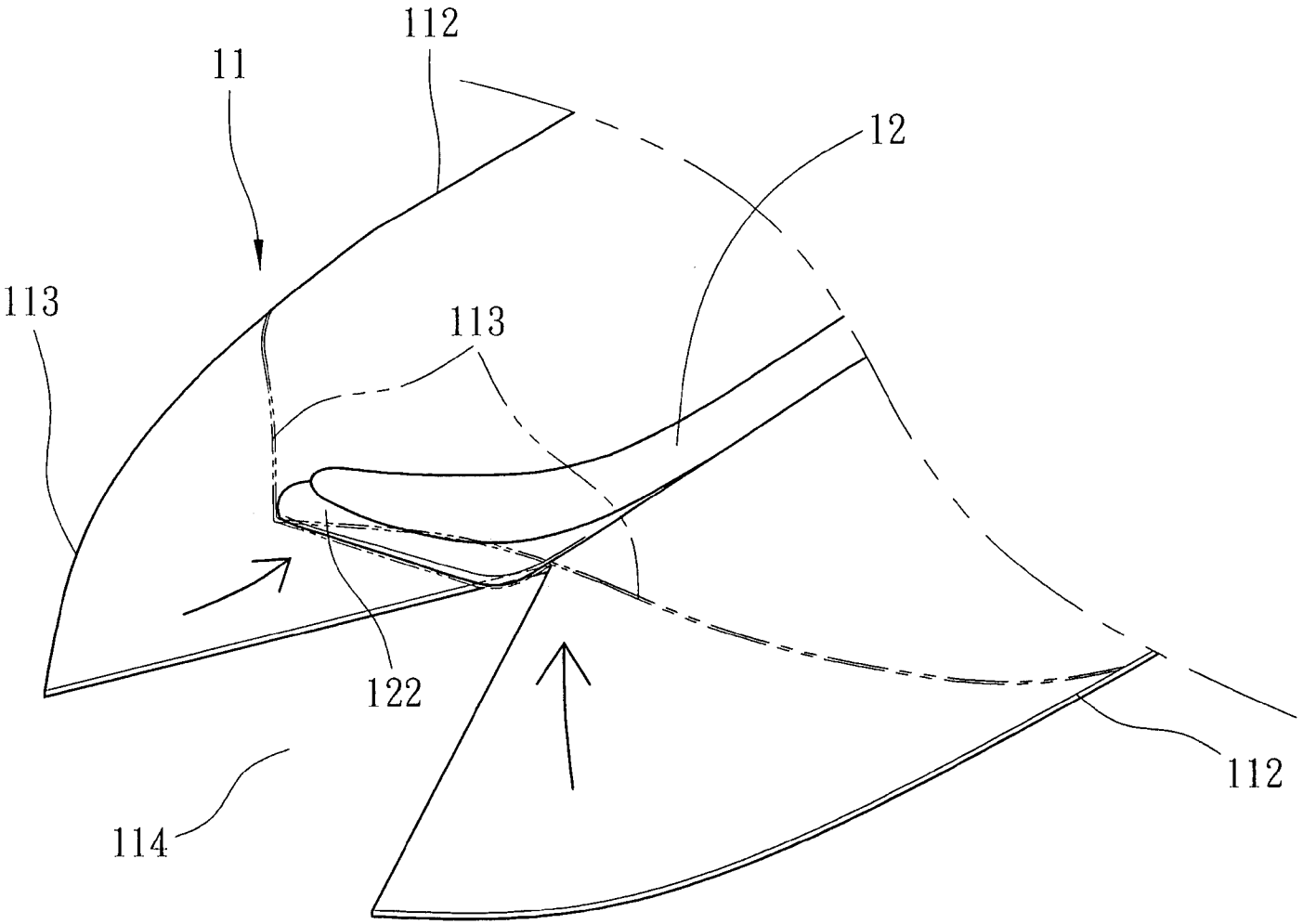
FIG. 3 is an extended view of a part of the present invention, showing the relationship between the front part of the flat bottom fabric member and the supplementary inflatable airbag member.

Referring to FIGS. 1~3, an inflatable rubber boat 1 is shown comprising a flat bottom fabric member 11, an elongated main inflatable airbag member 13, a supplementary inflatable airbag member 12, a floorboard member 14, a transom member 15, and at least one water drainer 16.

The flat bottom fabric member 11 has a front V-cut 114, and two lateral sides 112. The two border edges of the front V-cut 114 are seamed together, forming a forwardly upwardly curved front end edge 113 of the flat bottom fabric member 11.

The elongated main inflatable airbag member 13 is fastened to the forwardly upwardly curved front end edge 113 and two lateral sides 112 of the flat bottom fabric member 11.

Figures 4, 5:
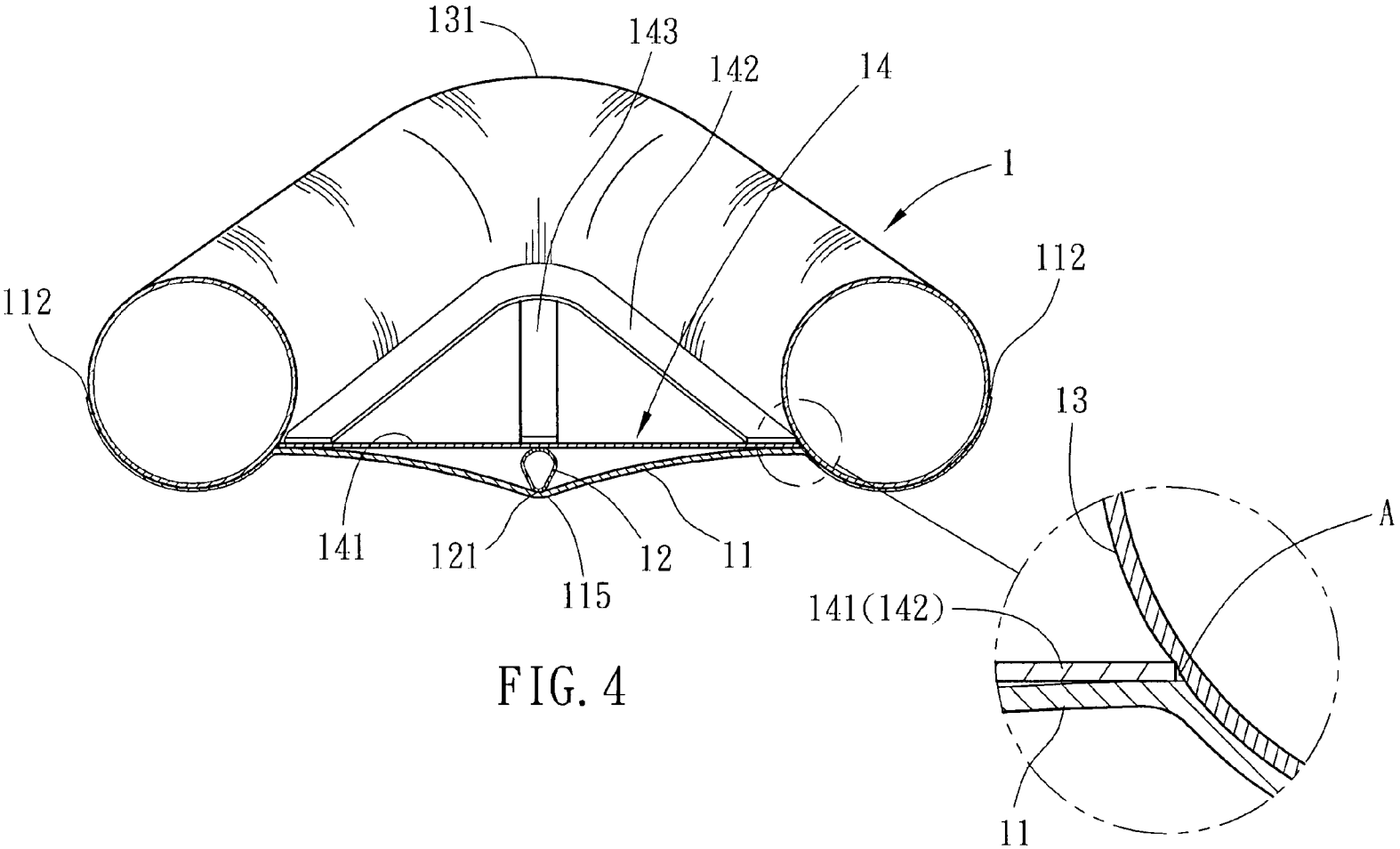
FIG. 4 is a sectional elevation of a part of the inflatable rubber boat in accordance with the present invention.
FIG. 5 is an enlarged view of a part of FIG. 4.

The floorboard member 14 comprises a body 141 fitting over the top surface of the flat bottom fabric member 11, a pointed arch-shaped rib 142 obliquely upwardly extended from the front side of the body 141 and fastened to the contained angle A defined between the upwardly curved front end edge 113 of the flat bottom fabric member 11 and the elongated main inflatable airbag member 13 (see FIGS. 4 and 5), and a brace 143 connected between the middle part of the pointed arch-shaped rib 142 and the front end of the body 141.

Figures 6, 7:
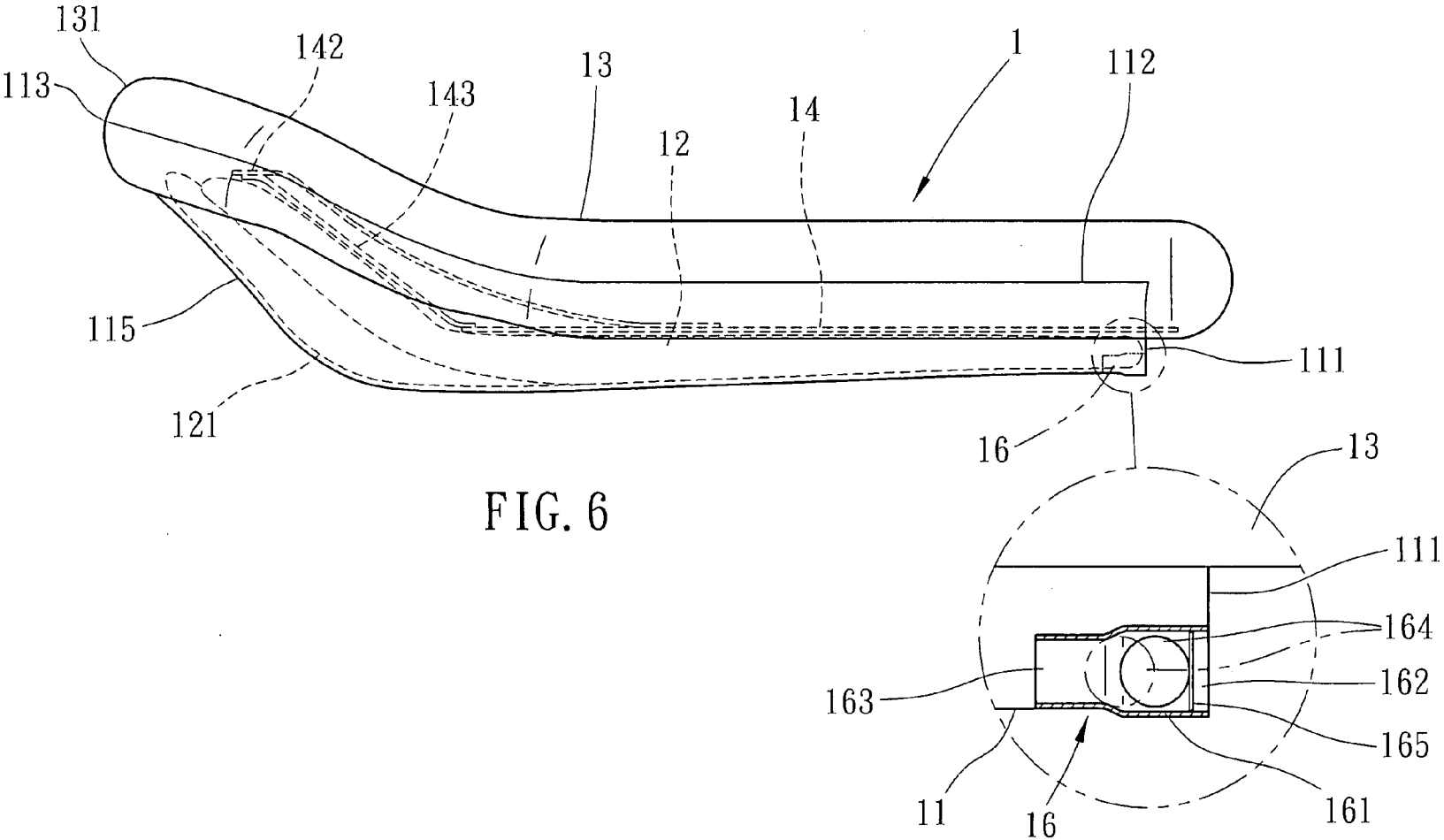
FIG. 6 is a sectional side plain view of the inflatable rubber boat in accordance with the present invention.
FIG. 7 is an enlarged view of a part of FIG. 6, showing the structure of the water drainer.

The supplementary inflatable airbag member 12 is longitudinally set between the floorboard member 14 and the flat bottom fabric member 11, and inflated to stretch the flat bottom fabric member 11 into shape. The supplementary inflatable airbag member 12 is shaped like a curved knife when viewed from one lateral side, having a pointed front inflation compartment 122 and a V-shaped edge 121 located on the bottom side of the front inflation compartment 122 so that a middle part of the elongated main inflatable airbag member 13 that is fastened to the pointed arch-shaped rib 142 of floorboard member 14 and forms the bow of the inflatable rubber boat is forced to curve forwardly upwards to facilitate water surface breaking and to reduce water resistance after inflation of the supplementary inflatable airbag member 12 (see FIGS. 4 and 6).

The transom member 15 is transversely connected between the two distal ends of the elongated main inflatable airbag member 13 at the rear side of the flat bottom fabric member 11.

The water drainer 16 is mounted in between the flat bottom fabric member 11 and the floorboard member 14 and affixed to a rear flap 111 of the flat bottom fabric member 11, comprising a stepped drain tube 161 and a ball 164 movably mounted in the stepped drain tube 161. The stepped drain tube 161 has a rear section 162 that accommodates the ball 164, a front section 163 that has an inner diameter relatively smaller than the inner diameter of the rear section 162 and the outer diameter of the ball 164, and a grille 165 that keeps the ball 164 in the rear section 162 (see FIG. 7). When the inflatable rubber boat 1 is immovable, the ball 164 is moved by intake water toward the front section 163 to stop the passage between the rear section 162 and the front section 163.

According to the present invention, the flat bottom fabric member 11, the elongated main inflatable airbag member 13 and the floorboard member 14 are separately prepared and then detachably fastened together. During delivery, the component parts of the inflatable rubber boat can be detached from one another and folded up to safe storage space. Further, the body 141, pointed arch-shaped rib 142 and brace 143 of the floorboard member 14 are detachable to facilitate delivery. Further, the body 141 can be formed of a number of parts detachably fastened together.

A prototype of inflatable rubber boat has been constructed with the features of FIGS. 1~7. The inflatable rubber boat functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An inflatable rubber boat, comprising:

a flat bottom fabric member formed of a fabric having a front V-cut and two lateral sides, two border edges of said front V-cut being seamed together to form a forwardly upwardly curved front end edge of said flat bottom fabric member;

an elongated main inflatable airbag member fastened to the forwardly upwardly curved front end edge and two lateral sides of said flat bottom fabric member;

a floorboard member, said floorboard member comprising a body fitting over said flat bottom fabric member, a pointed arch-shaped rib obliquely upwardly extended from a front side of said body and fastened to the contained angle defined between said upwardly curved front end edge of said flat bottom fabric member and said elongated main inflatable airbag member; and a supplementary inflatable airbag member longitudinally set between said floorboard member and said flat bottom fabric member and inflated to stretch said flat bottom fabric member into shape.

2. The inflatable rubber boat as claimed in claim 1, wherein said floorboard member further comprises a brace connected between a middle part of said pointed arch-shaped rib a front end of said body.

3. The inflatable rubber boat as claimed in claim 1, wherein said supplementary inflatable airbag member is shaped like a curved knife.

4. The inflatable rubber boat as claimed in claim 1, wherein said supplementary inflatable airbag member comprises a V-shaped edge located on a bottom side and longitudinally extended to a front end thereof.

5. The inflatable rubber boat as claimed in claim 1, further comprising a transom member transversely connected between two distal ends of said elongated main inflatable airbag member at the rear side of said flat bottom fabric member.

6. The inflatable rubber boat as claimed in claim 1, further comprising a water drainer mounted in between said flat bottom fabric member and said floorboard member and affixed to a rear flap of said flat bottom fabric member, said water drainer comprising a stepped drain tube and a ball movably mounted in said stepped drain tube, said stepped drain tube comprising a rear section that accommodates said ball, a front section that has an inner diameter relatively smaller than the inner diameter of said rear section and the outer diameter of said ball, and a grille that keeps said ball in said rear section.

7. The inflatable rubber boat as claimed in claim 1, wherein said pointed arch-shaped rib of said floorboard member is detachably connected to said body of said floorboard member.

8. The inflatable rubber boat as claimed in claim 1, wherein said body of said floorboard member is formed of a number of parts detachably fastened together.

9. The inflatable rubber boat as claimed in claim 1, wherein said supplementary inflatable airbag member comprises a pointed front inflation compartment that forces the bow of the inflatable rubber boat to curve forwardly upwards when inflated.

* * * * *